US005911869A

United States Patent [19]

Greaney

[11] Patent Number: 5,911,869

[45] Date of Patent: Jun. 15, 1999

[54] METHOD FOR DEMETALLATING PETROLEUM STREAMS (LAW639)

[75] Inventor: Mark Alan Greaney, Upper Black Eddy, Pa.

[73] Assignee: Exxon Research and Engineering Co., Florham Park, N.J.

[21] Appl. No.: 08/987,403

[22] Filed: Dec. 9, 1997

[51] Int. Cl.[6] ..... C01G 32/00

[52] U.S. Cl. ..... 205/688; 205/695; 205/696; 204/514; 204/559; 204/567

[58] Field of Search ..... 205/688, 695, 205/696; 204/514, 559, 567

[56] References Cited

U.S. PATENT DOCUMENTS 2,140,194 12/1938 Yabroff et al. ..... 204/9

4,260,484 4/1981 Connolly ..... 204/551

5,529,684 6/1996 Greaney et al. ..... 205/695

*Primary Examiner*—Arun S. Phasge

*Attorney, Agent, or Firm*—Linda M. Scuorzo

[57] ABSTRACT

The present invention provides for a process for electrochemically demetallating petroleum streams by contacting a hydrocarbon-soluble metals containing petroleum stream and an aqueous electrolysis medium with a low hydrogen overpotential metal cathode at an electric current and pH sufficient to demetallate the petroleum stream. The cathode voltage is from 0 V to −3.0 V vs. SCE at a pH of from 7 to 14. The cathode material typically is stainless steel, chromium, copper and nickel.

13 Claims, No Drawings

METHOD FOR DEMETALLATING PETROLEUM STREAMS (LAW639)

FIELD OF THE INVENTION

The present invention relates to a method for electrochemically demetallating refinery feedstreams.

BACKGROUND OF THE INVENTION

Petroleum streams that contain metals are typically problematic in refineries as streams because the metallic components contained therein have a negative impact on certain refinery operations. Thus, demetallation has been referred to as critical to help conversion of crude fractions (see e.g., Branthaver, Western Research Institute in Ch. 12, "Influence of Metal Complexes in Fossil Fuels on Industrial Operations", Am. Chem. Soc. (1987)). Such metals, for example, act as poisons for hydroprocessing and fluid catalytic cracking catalysts, thereby, shortening the run length of such processes, increasing waste gas make and decreasing the value of coke product from coker operations.

The presence of such metals prevents more advantageous use of the petroleum streams by rendering especially the heaviest oil fractions (in which these metal containing structures most typically occur) less profitable to upgrade, and when these resources are used make catalyst replacement/disposal expensive. Current refinery technologies typically address the problem by using metal containing feedstreams as a less preferred option, and by tolerating catalyst deactivation when there are not other feedstream alternatives available.

Electrochemical processes have been used for removal of water soluble metals from aqueous streams, see, e.g., U.S. Pat. No. 3,457,152. Additionally, U.S. Pat. No. 5,529,684 discloses the electrochemical treatment of refinery streams, which is carried out at specific cathodic potentials. Disclosed in the '684 patent as suitable electrodes are high hydrogen overpotential electrodes such as lead and zinc. There is a continuing need for cost effective methods for removal of metals from refinery feed streams. Applicant's invention addresses this need.

SUMMARY OF THE INVENTION

The present invention provides for a method for demetallating petroleum streams comprising passing an electric current through a hydrocarbon soluble metals-containing petroleum stream and an aqueous electrolysis medium, in the presence of a cathode having a low hydrogen overpotential at a sufficient cathodic potential and at a pH sufficient to produce a treated petroleum stream having a decreased metals content. Unexpectedly, the low hydrogen overpotential cathodes perform comparably to high hydrogen overpotential cathodes.

The present invention may suitably comprise, consist or consist essentially of the described elements and may be practiced in the absence of an element not disclosed.

DETAILED DESCRIPTION OF THE INVENTION

The present invention provides for a method for electrochemically decreasing the metals content of a petroleum fraction by contacting a mixture or solution of a metals-containing hydrocarbonaceous petroleum fraction or phase (also referred to herein as a stream or feed or feedstream) and an aqueous electrolysis medium to a low hydrogen overpotential cathode at a cathodic electric current and pH sufficient to remove metals from the stream (i.e., to produce a petroleum fraction having decreased content of the metals). The petroleum stream and aqueous electrolysis medium are contacted under conditions to result in passing of an electric current therethrough. Thus electrolytic reduction at the cathode of the electrolytic cell yields petroleum streams or fractions having a decreased metals content from the starting material.

The art teaches that reductive electrochemistry in the presence of an aqueous medium must be carried out using high hydrogen overpotential cathodes in order to minimize hydrogen evolution at the cathode. High hydrogen overpotential metals typically include lead, cadmium, zinc, mercury, tin, and alloys thereof (see, e.g., Danly, *Hydrocarbons Processing*, p. 163, April 1981). The use of low hydrogen overpotential materials can lead to hydrogen production at the cathode which is an undesirable competing reaction to the desired demetallation reaction. This undesirable reaction can lead to lower cell productivity and higher power consumption.

Low hydrogen overpotential cathodes, i.e., those metals and metallic alloys having exchange current densities of greater than $10^{-8}$ A/cm$^2$ typically $10^{-8}$ to $10^{-2}$ A/cm, in 1 mol/dm$^3$/$H_2SO_4$ at 20° C. (see Pletcher, Industrial Electrochemistry, Ch. 1, Section 1.5.1, 1993 Blackie A&P, 2nd ed.), including metals such as iron, copper, chromium, and nickel and metallic alloys such as stainless steels and carbon steels are not expected to provide suitable demetallation performance for the reasons stated above. However, unexpectedly, Applicant has found that the use of a low hydrogen overpotential cathode, provides performance comparable to high hydrogen overpotential metal electrodes. Thus, stainless steel has provided performance comparable to high hydrogen overpotential metals such as lead, cadmium and zinc as measured in terms of relative cell productivity (barrels/hour-m$^2$) and power consumption (kW-hr/barrel).

The metallic species that may be removed by the process of the present invention include Ni and V species, as these are typically present in petroleum streams and are not removed advantageously or cost-effectively by other demetallation treatments. Transition metals such as Ni and V are often found, for example, in porphyrin and porphyrin-like complexes or structures, and are abundant as organometallic structures in heavy petroleum fractions. In these feeds such metal species tend to be found in non-water soluble or immiscible structures.

The process of this invention also may be applied to the removal of metals that are more easily reduced than Ni and V, such as Fe. However, since other processing options are available for removal of such other metals, the process is most advantageous for removal of the metals Ni, V, as these are not suitably removed by other processes. A benefit of the process of the present invention is in its use to remove metals contained in typically non-water extractable metal containing organic moieties such as hydrocarbon soluble metal containing structures.

By contrast, water soluble metal salts typically are currently removed from petroleum streams using an electrostatic desalter process. This process entails applying an electric field to aid in separation into essentially water-containing and essentially hydrocarbon-containing phases. The water soluble metal salts are thereby extracted and removed from the petroleum streams. By contrast to the present invention, high voltage is applied in the absence or essential absence of current flow and the metals that are removed are essentially not hydrocarbon soluble. In the present invention the demetallation that is carried out decreases the metals content of the organic (i.e., essentially hydrocarbon-containing) phase.

Examples of Ni and V metal-containing petroleum streams, phases or fractions, including distillates thereof, that may be treated according to the process of the present invention are metals containing cabonaceous and hydrocarbonaceous petroleum streams of fossil fuels such as crude oils and bitumens, as well as processed streams (distillation resids) such as atmospheric vacuum resid, fluid catalytic cracker feeds, metal containing deasphalted oils and resins, process resids and heavy oils (heavy crudes) as these typically have a high metals content.

The feed to be demetallated can have a range of metals content above zero. The average vanadium in the feed is typically about 10 ppm to 2,000 ppm, more typically about 10 to 1,000 ppm, by weight, most typically about 20 to 100 ppm. The average nickel content in the starting feed is typically about 2 to 500 ppm, preferably about 2 to 250 ppm by weight, most preferably about 2 to 100 ppm. For example, a Heavy Arab crude distillate having an initial cut point of 950° F. (510° C.) and a final cut point of 1160° F. (627° C.) may have a typical nickel content of 8 ppm and a vanadium content of 50 ppm by weight. However, any level of such metals may be treated according to the present invention.

The metals-containing petroleum faction preferably should be in a liquid or fluid state at process conditions. This may be accomplished by heating the material or by treatment with a suitable solvent as needed. This assists in maintaining the mixture of the metals-containing petroleum stream and aqueous electrolysis medium in a fluid form to allow passage of cathodic current. Current densities of 1 $mA/cm^2$ of cathode surface area or greater area are suitable.

Preferably droplets should be of sufficient size to enable the metals containing components to achieve intimate contact with the aqueous electrolysis medium. Droplet size particles of about 0.1 micron to 1.0 mm, for example are suitable. Contacting is typically accomplished by intimate mixing of the metal containing petroleum stream and the aqueous electrolysis medium to form a mixture or oil-in-water dispersion, for example using a stirred batch reactor or turbulence promoters in flowing cells.

Desirably the process should be carried out for a time and at conditions within the ranges disclosed sufficient to achieve a decrease, preferably a maximum decrease, in content of the metals.

Reaction temperatures will vary with the particular petroleum stream due to its viscosity, and the type of electrolyte and its pH. However, temperatures may suitably range from about ambient to about 700° F. (371° C.), preferably from 100° F. (38° C.) to 200° F. (93° C.), and pressures of from 0 atm (0 kPa) to 210 atm (21,200 kPa), preferably 0 atm (0 kPa) to 3 atm (303 kPa). An increase in temperature may be used to facilitate removal of metal species. Within the process conditions disclosed a liquid or fluid phase or medium is maintained.

Following demetallation, the product petroleum stream contains a reduced level of these metals (e.g., Ni and/or V and/or Fe). While the actual amount removed will vary according to the starting feed, on average, vanadium levels of not more than about 15 ppm by weight, desirably less than about 4 ppm and on average nickel levels of less than about 10 ppm, more desirably less than about 2 ppm can be achieved. Greater than 30 percent by weight of the total vanadium and nickel can thereby be removed.

The metal decreased product may be used in refining operations that are adversely affected by higher levels of metals, for example fluid catalytic cracking or hydroprocessing, or such a product can be blended with other streams of higher or lower metals content to obtain a desired level of metals removal.

The electrolyte in the aqueous electrolysis medium is desirably an electrolyte that dissolves or dissociates in water to produce electrically conducting ions at the required pH, but that does not undergo redox in the range of applied potentials used. Organic electrolytes include quaternary carbyl and hydrocarbyl onium salts, e.g. alkylammonium hydroxides. Inorganic electrolytes include, e.g., NaOH, KOH and sodium phosphates. Mixtures thereof also may be used. Suitable onium ions include mono- and bis-phosphonium, sulfonium and ammonium, preferably ammonium ions. Carbyl and hydrocarbyl moieties are preferably alkyl. Quaternary alkyl ammonium ions include tetrabutyl ammonium, and tetraethyl ammonium. Optionally, additives known in the art to enhance performance of the electrodes or the system may be added such as surfactants, detergents, emulsifying agents and anodic depolarizing agents. Basic electrolytes are most preferred. The concentration of electrolyte in the electrolysis medium should be sufficient to generate an electrically conducting solution in the presence of the petroleum component. Typically an electrolyte concentration of 1–50 wt% of the aqueous phase, preferably 5–35 wt/% is suitable.

Within the process conditions disclosed, the pH of the aqueous electrolysis medium can vary from 7 to 14, more from above 7 to 14. The pH of the solution of the petroleum fraction in the aqueous electrolysis medium will vary with the metals to be removed.

It is possible to carry out the process in air or under an inert atmosphere. The process may be operated under ambient temperature and atmospheric pressure, although higher temperature and pressures also may be used as needed. The process is carried out in an electrochemical cell, by electrolytic means, i.e. in a non-electrostatic mode, as passage of current through the mixture or oil-in-water dispersion is required (e.g., relatively low voltage/high current). The cell may be either divided or undivided. Such systems include stirred batch or flow through reactors. The foregoing may be purchased commercially or made using technology known in the art. Included as suitable electrodes are three-dimensional electrodes, such as metallic foams, stacks of metal mesh or expanded metal sheets.

The cathodic voltage will vary depending on the metal to be removed. The cathodic voltage is in the range 0 to −3.0 V versus Saturated Calomel Electrode (SCE), preferably −1.0 to −2.5 V based on the characteristics of the particular petroleum fraction. While direct current is typically used, electrode performance may be enhanced using alternating current, or other voltage/current waveforms.

The invention may be described with reference to the following non-limiting examples.

EXAMPLE 1

One hundred grams of deasphalted vacuum resid were combined with four hundred milliliters of an aqueous electrolyte consisting of 35 wt% sodium hydroxide, 5% tetrabutylammonium hydroxide and 0.5 milliliters of non-ionic surfactant octyl phenoxy polyethoxy ethanol (Triton®-x-100) from Union Carbide. This mixture was added to a glass vessel and heated to 110° C. under 40 kPA pressure of nitrogen and recirculated to produce a fine oil-in-water dispersion. The electrochemical cell consisted of two flat plate metallic electrodes (1.27×30.5 cm) separated by a 3.2 mm gap. The experiment was conducted at a controlled current of 1.0 amp, which corresponds to a current density of 258 $A/m^2$. Samples of the circulating reaction mixture were removed at periodic intervals and the vanadium content was analyzed by Electron Paramagnetic Resonance (EPR) spectroscopy.

By analyzing the rate of demetallation by graphical techniques, an estimate of the time required to achieve 90% demetallation is obtained, which then allows for calculation of the cell productivity for the run. The cell productivity figure equals the area of electrode required to achieve 90% demetallation of a feed at a given throughput (barrels/hour). During the course of the experiment, the amount of power consumed can be calculated from the measured current and voltage, as well as by coulometry. The amount of power consumed to achieve 90% demetallation is then converted into the power consumption units of kilowatt-hours/barrel. Relative data listed in Table 1 were calculated by ratioing the cell productivity and power consumption values to the value measured for cadmium.

The runs listed in Table 1 below were identical except in the composition of the metallic cathodes. For the zinc, lead and cadmium, 99.9+ purity metal sheet from commercial suppliers was used. The stainless steel was type 304. The results demonstrate that, unexpectedly, the low hydrogen overpotential stainless steel cathode had comparable performance to the high hydrogen overpotential lead, cadmium and zinc cathodes, in terms of relative cell productivity. Beneficially, power consumption was lower with the stainless steel cathode.

TABLE 1

| Cathode | Relative Cell Productivity (Barrels/hour-$m^2$) | Relative Power Consumption (kW-hr/Barrel) |
|---|---|---|
| lead | 1.0 | 1.1 |
| cadmium | 1.0 | 1.0 |
| zinc | 1.1 | 0.93 |
| stainless steel | 1.3 | 0.76 |
| carbon steel | 1.2 | 0.86 |
| Alloy 400* | 1.1 | 0.97 |

*66% nickel, 31% copper, 1.4% iron, 0.15% carbon

What is claimed is:

1. A process for electrochemically demetallating petroleum streams, comprising: contacting a hydrocarbon-soluble metals containing petroleum stream and an aqueous electrolysis medium with a low hydrogen overpotential metal cathode at an electric current and pH sufficient to demetallate the petroleum stream.

2. The process of claim 1 wherein the low hydrogen overpotential cathode has an exchange current density of $10^{-8}$ to $10^{-2}$ $A/cm^2$ at 20° C. in 1 $mol/dm^3$ $H_2SO_4$.

3. The process of claim 1 wherein the low hydrogen overpotential cathode is a metal selected from iron, copper, nickel, and chromium and alloys thereof, stainless steels and carbon steels.

4. The process of claim 1 wherein the electric current is at a cathodic voltage of from 0 to −3.0 V vs. SCE.

5. The process of claim 1 wherein the electric current is at a cathodic voltage of from about −1.0 to −2.5 V vs. SCE.

6. The process of claim 1 wherein the petroleum stream is selected from the group consisting of crude oils, catalytic cracker feeds, bitumen, and distillation resids.

7. The process of claim 1 wherein the aqueous electrolysis medium contains salts selected from the group consisting of inorganic salts, organic salts and mixtures thereof.

8. The process of claim 1 wherein the aqueous electrolysis medium has a pH of from 7 to 14.

9. The process of claim 1 wherein the aqueous electrolysis medium has a pH of from above 7 to 14.

10. The process of claim 1 wherein the temperature is up to 700° F. (371° C.).

11. The process of claim 1 wherein the pressure is from about 0 atm (0 kPa) to about 210 atm (21,200 kPa).

12. The process of claim 1 wherein the concentration of the electrolyte in the aqueous electrolysis medium is 1 to 50 wt %.

13. The process of claim 1 wherein the metals containing petroleum stream and aqueous electrolysis medium form an oil in water dispersion.

* * * * *